10/15/85 X5 4,546,555

United States Patent [19]

Spademan

[11] Patent Number: 4,546,555

[45] Date of Patent: Oct. 15, 1985

[54] SHOE WITH SHOCK ABSORBING AND STABIIZING MEANS

[76] Inventor: Richard G. Spademan, 130 Country Club Dr. #30, Incline Village, Nev. 89502

[21] Appl. No.: 477,052

[22] Filed: Mar. 21, 1983

[51] Int. Cl.[4] ..... A43B 7/06; A43B 7/08

[52] U.S. Cl. ..... 36/28; 36/3 B; 36/35 R; 36/29

[58] Field of Search ..... 36/28, 29, 3 R, 3 B, 36/35 R, 35 B

[56] References Cited

U.S. PATENT DOCUMENTS

| | | | |
|---|---|---|---|
| 622,673 | 4/1899 | Ferrata | 36/3 B |
| 1,364,226 | 1/1921 | Wherry | 36/3 R |
| 1,403,970 | 1/1922 | Lloy | 36/3 B |
| 2,863,230 | 12/1958 | Cortina | 36/35 R |
| 3,180,039 | 4/1965 | Burns, Jr. | 36/29 |
| 3,225,463 | 12/1965 | Burnham | 36/29 |
| 3,253,355 | 5/1966 | Menken | 36/29 |
| 3,716,930 | 2/1973 | Brahm | 36/3 B |
| 4,342,158 | 8/1982 | McMahon et al. | 36/35 R |
| 4,414,760 | 11/1983 | Faiella | 36/29 |
| 4,417,407 | 11/1983 | Fukuoka | 36/3 B |

FOREIGN PATENT DOCUMENTS

| | | | |
|---|---|---|---|
| 13911 | 7/1892 | United Kingdom | 36/35 B |

*Primary Examiner*—Werner H. Schroeder
*Assistant Examiner*—Steven N. Meyers
*Attorney, Agent, or Firm*—Townsend and Townsend

[57] ABSTRACT

A shoe having a shock absorber therein. In one embodiment, the shock absorber includes an inflatable member having a hole placing the interior of the inflatable member in fluid communication with the atmosphere. The shock absorber is restrained by a stabilizing structure against lateral instability. The stabilizing structure is in the form of a box of any one of several configurations. During foot strike, air is forced out of the inflatable member to cushion the heel while the stabilizing structure keeps it stable in the shoe. During toe-off of the shoe and swing-through to the foot strike, atmospheric air enters the inflatable member and inflates the same so that the member is ready to cushion the foot during the next foot strike. Several embodiments of the shock absorber are disclosed.

40 Claims, 18 Drawing Figures

FIG. 1
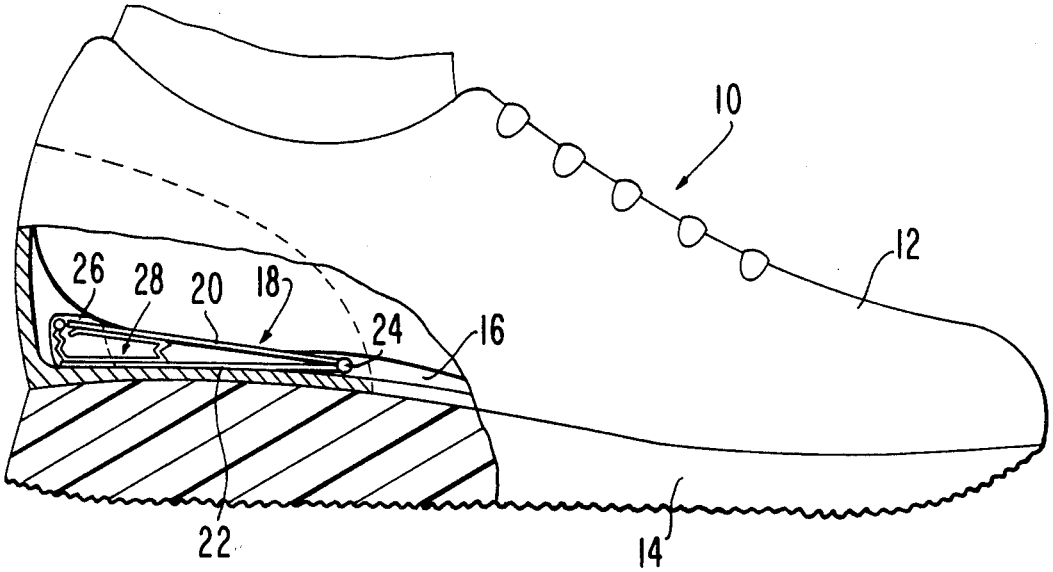
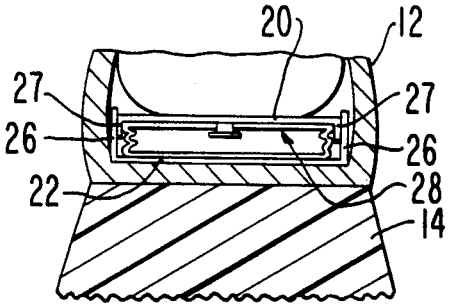
FIG. 1A
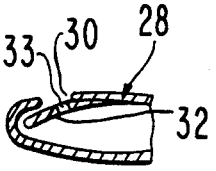
FIG. 1B
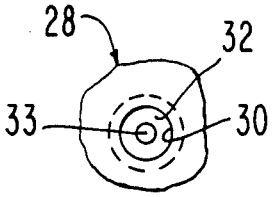
FIG. 1C
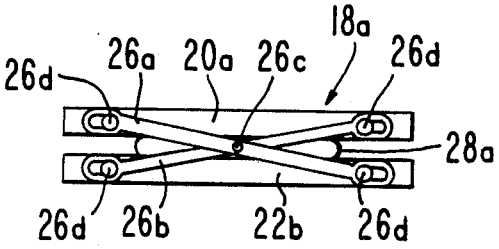
FIG. 1D
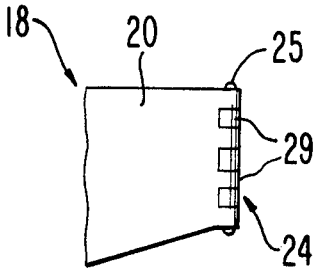
FIG. 1E FIG. 4
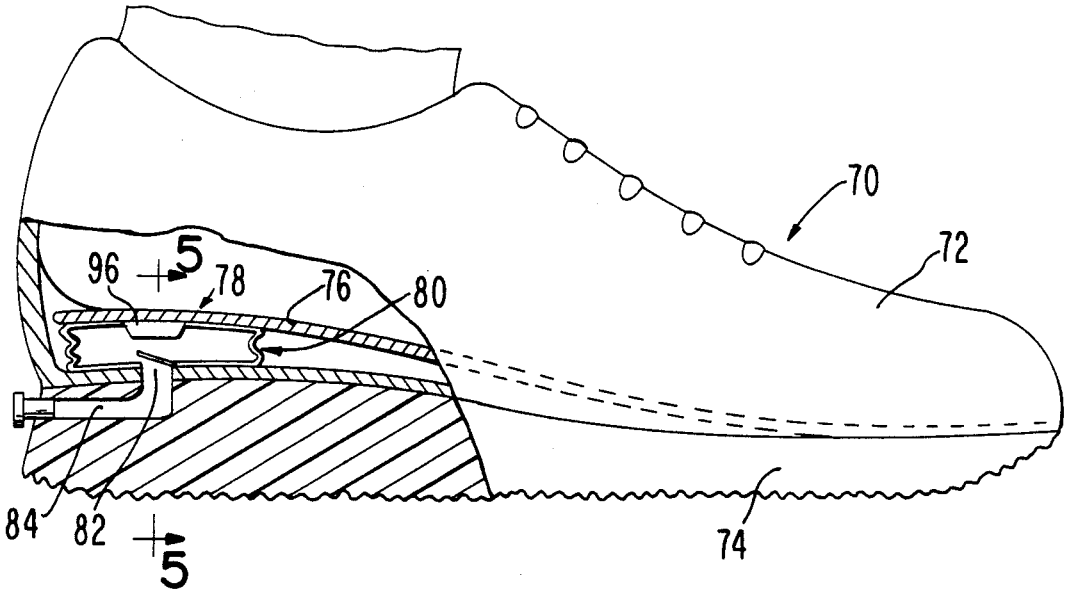
FIG. 5
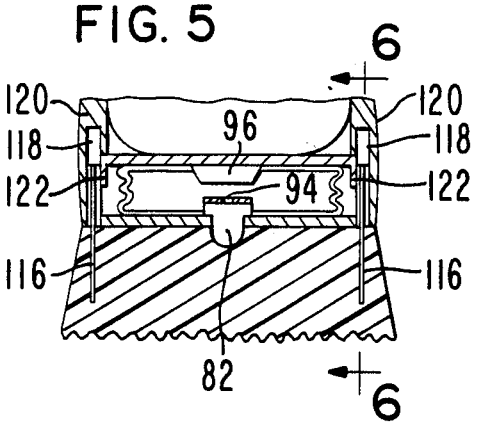
FIG. 5a
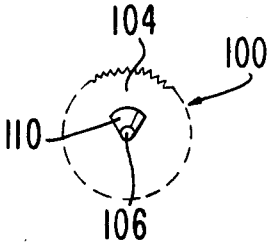
FIG. 5b
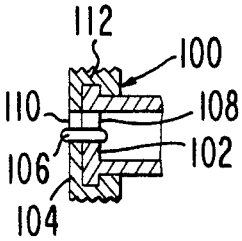
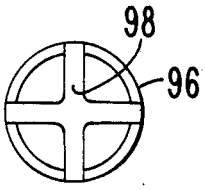
FIG. 5c
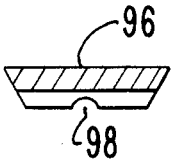
FIG. 5d
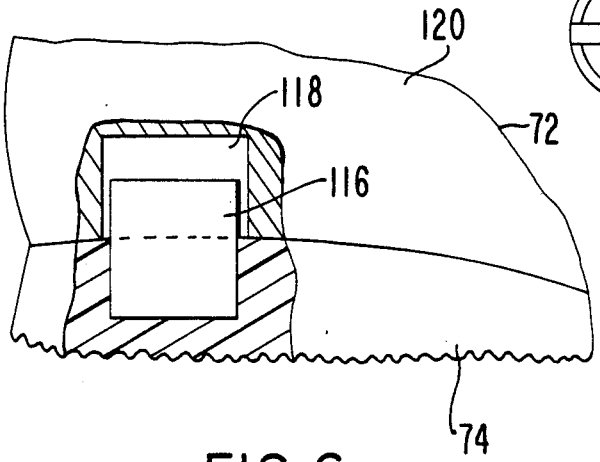
FIG. 6

FIG. 7
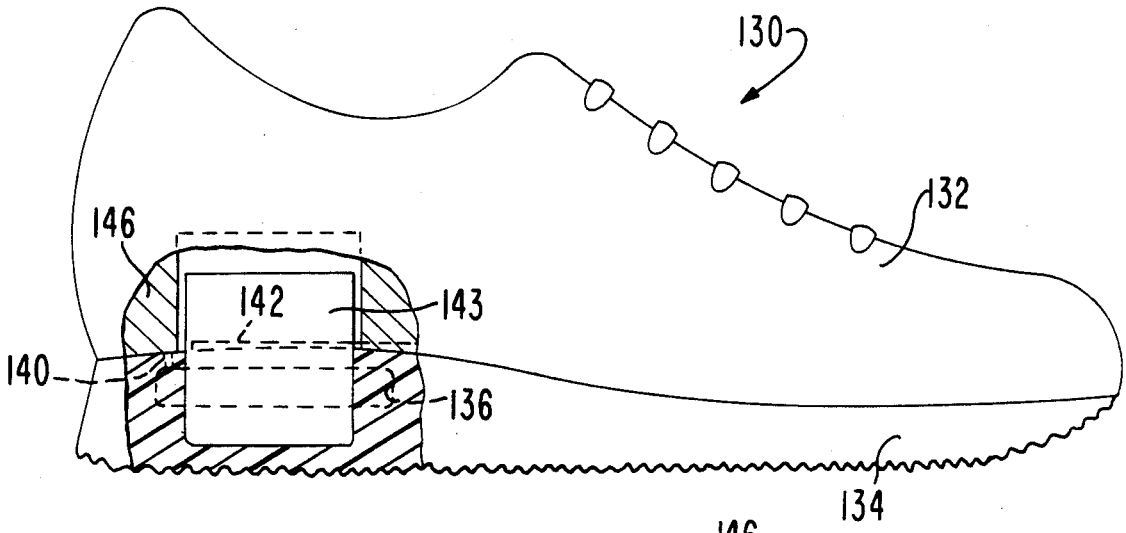
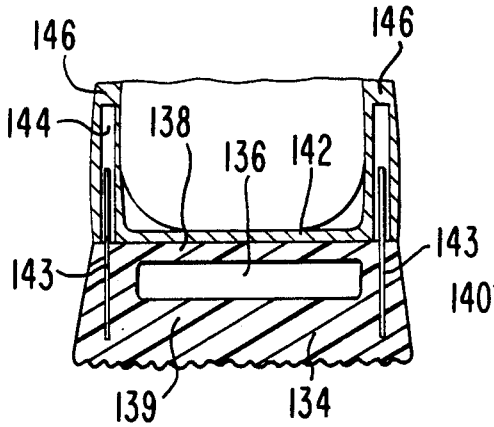
FIG. 8
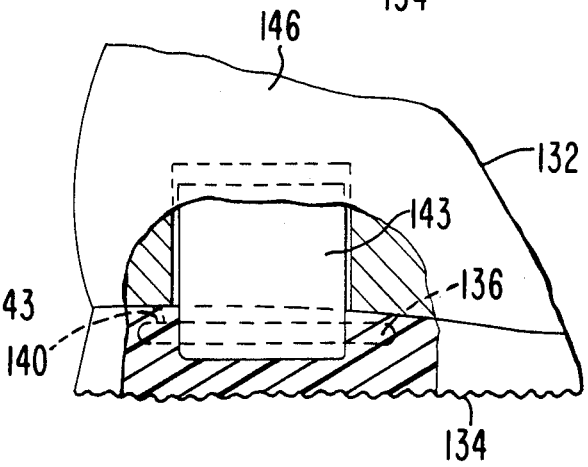
FIG. 9

SHOE WITH SHOCK ABSORBING AND STABIIZING MEANS

BACKGROUND OF THE INVENTION

In a sport shoe, shock absorption upon foot strike is a vital consideration in protecting the lower extremity from injury. Distance runners usually impact the ground at the heel and with a force as high as three times the body weight. Most running shoes have been made with resilient elastomer (EVA) soles to at least partially cushion such impact. Other shoes have been constructed with shock absorption systems that include open or closed gas or liquid filled bladders. As these various soles are made thicker or contain more or larger air cells, bladders or tubes to improve shock absorption characteristics, the shoes become increasingly unstable. This instability is not particularly critical in a longitudinal direction. However, instability in a lateral direction adversely effects the function of the foot and leg in distance running and other sports and significantly increases the probability of acute and chronic lower extremity injury.

In distance running, from toe off until foot strike, the lower extremity is internally rotated, placed toward the midline of the body, and the foot is in a raised arch or supinated position. Most runners contact the ground with the outside edge of their shoes and for approximately ten to twenty percent of the total time the foot is on the ground, the foot continues to internally rotate. The foot longitudinal arch also lowers or pronates. This pronation, which occurs in the subtalar joint, allows the foot to act as a shock absorber and to become a mobile adapter to varying types of surfaces. The ground contact usually occurs with between two to four degrees of supination. The heel then angulates inwardly as the foot flattens about six degrees to a pronated position.

Many runners have a tendency to overpronate which makes subsequent raising of the longitudinal arch (supination) and external rotation of the foot to form a rigid lever for effective toe off more difficult. This "rolling" movement of the rear foot toward the inside (pronation) during midstance is exaggerated if the sole is particularly thick and soft or if the heel counter is unstable. This overpronation can lead to imbalance and overuse injuries which are common disabilities among runners. The subtalar joint functions as a mitered hinge with a diagonal or oblique axis. Thus, when the foot pronates excessively, the leg is forced to rotate inwardly to an excessive degree causing abnormal stress on the cartilage and musculotendinous components of the foot, leg and knee.

Repeated and continuous stress can cause numerous disorders. The additional load on the plantar fascia of the foot because of excessive pronation can result in plantar fascutes. "Shin splints" caused by traction on the posterior tibialis muscle and tendon which raises the longitudinal arch or tarsal tunnel syndrome caused by excessive friction on the posterior tibialis tendon under the medial malleolus, are pronation related disabilities. Torque on the achilles tendon initiates and aggravates achilles tendonitis. The abnormal internal rotation of the leg causes a stress on the structures of the medial aspect of the knee with pes anserinus bursitis being a common ailment. Misalignment of the quadraceps tendon can cause patellar compression syndrome due to the increased and abnormal pressure on the patellar cartilage.

Since foot impact is approximately two times body weight on level terrain and three times body weight in downhill running, a shoe sole that will deform to absorb the considerable energy of impact with minimal lateral instability is necessary to prevent injury. Several sport shoe manufacturers have attempted to solve this problem of lateral instability by various means including use of a stabilizing bar that traverses the midsole and heel counter (Converse), a stabilizing pillar in the midsole (Asics), a semirigid external heel counter that traverses the midsole (New Balance), and a stabilizing varus wedge in the midsole (Brooks). In all of these attempts to control lateral instability, the shock absorption qualities of the midsole are significantly compromised. This is because the stabilizer decreases the potential vertical compression or deformation of the midsole available for energy absorption. Also, these rigid or semirigid stabilizers cause the sole to "bottom out". Although most distance runners contact the ground with the outside edge of their shoes, this contact force is small. By the time the force reaches twice the body weight the distribution is centered approximately twenty five percent forward of the shoe length from the heel and near the midline of the shoe. It is, therefore, essential that the shoe sole provide maximum vertical shock absorption toward the center of the heel while minimizing lateral instability.

Disclosures relating to shock absorption systems for shoes include the following U.S. Pat. Nos.:

| | |
|---|---|
| 663,270 | 3,716,930 |
| 2,474,815 | 3,754,339 |
| 3,029,530 | 3,785,069 |
| 3,120,712 | 3,791,051 |
| 3,180,039 | 4,183,156 |
| 3,335,505 | 4,215,492 |
| 3,475,836 | 4,219,945 |
| 3,589,037 | 4,224,746 |
| | 4,237,625 |

SUMMARY OF THE INVENTION

The present invention provides an improved shoe having a shock absorption system in which the absorption of shock and other impact loads and the lateral stability of the shoe are increased over those achieved with conventional shock absorption systems for shoes while reducing sole wear. The present invention provides a shoe with a shock absorption system which has either a closed cell elastomer or bladder construction, or a chamber or tube construction that is open to the atmosphere. In the later embodiments, air can flow out of the system to the atmosphere during heel strike and air can flow into the system from the atmosphere during toe off and swing-through when the shoe is off the support surface therebelow during walking and running. In each of these constructions, members shiftable relative to the shoe are included to minimize lateral instability.

In one embodiment, the present invention includes a shoe having means defining an air chamber with an unobstructed air hole which allows the air chamber to communicate directly with the atmosphere at all times. In another embodiment, the invention has an air chamber defined by a flexible bladder which has a relatively large air hole and an internal flapper valve which can move across the hole during foot strike. The valve has a relatively small hole therethrough to allow limited flow of air out of the air chamber during foot strike yet air can easily enter the bladder when the shoe is being lifted during toe off and swing-through because the valve is unseated and opens the relatively large hole. Thus, a bellows effect is created with the use of the bladder. Because the bladder can collapse to a minimal height during foot strike and the shock absorption system includes members shiftable relative to the shoe, stability and cushioning of the foot are significantly increased for the distance between the heel and the ground during midstance compared to that achieved with shoes having conventional shock absorbing systems therein.

The present invention includes shiftable stabilizing plates located in the sole and heel counter of the shoe. These stabilizing plates can shift vertically in the sole and heel counter to permit maximum vertical displacement of the sole or deformation of the elastomer shock absorber or bladder of the shoe and yet permit only minimum lateral displacement of the sole or lateral deformation of the cellular material in the midsole. Lateral displacement can result in angulation of the sole and heel counter with consequent overpronation of the foot. Longitudinal instability of the sole is not critical in preventing overpronation and formation of the rigid lever for toe off. This design provides for displacement and cellular material elastic deformation in vertical and longitudinal directions to maximize shock absorption, elastic rebound and lateral stability of the shoe.

The stabilizing structure of the present invention is based on the observation that the rigid lower portion of the shoe heel counter can be utilized to form a rigid box in which stabilizing plates are nested. These plates extend from the lower portion of the box into the midsole and can telescope further into the heel counter box or cavity upon foot strike. Nesting of the plates in the rigid box prevents rotary or angular movement of the plates. These plates can be made of metal or plastic or other materials and can be rigid or semirigid. As the thickness of the elastomer midsole is increased to improve cushioning, lateral instability increases. As the size of the elastomer air cells or included bladder or tubes increase lateral instability increases. This is particularly apparent in a closed gas or liquid filled bladder which also provides less reliability, longevity and greater cost of manufacture than an open bladder. A relatively large bladder or chamber which is open to the atmosphere provides the greatest potential cushioning or shock absorption while retaining reliability, longevity and lower cost of manufacture. However, a large open bladder presents a formidable problem in preventing undesirable lateral instability. Lateral, vertically shiftable stabilizing plates in a shoe sole and heel counter allow the greater potential shock absorption qualities of an open bladder to become a practical and efficient means for absorbing foot strike energy in a shoe.

If a shock absorber insert is used in the shoe or a dynamically movable footbed insert is utilized with or without stabilizing plates in the sole, lateral stability is increased by the use of meshing plates or telescoping pillars on the sides or rear of the shoe inserts to prevent the upper and lower surfaces from tilting or angulating to the side.

The primary object of the present invention is to provide an improved shoe having a shock absorption system in which the system is open to the atmosphere to allow air to flow into an air chamber of the system during raising of the foot off the support surface therebelow yet air will be forced out of the air chamber during heel strike on the support surface so that the shoe can provide improved shock absorption capabilities for the foot yet the lateral stability of the shoe remains high so as to provide comfort for the wearer of the shoe and support for the foot regardless of the impact forces exerted on the shoe by the foot during walking or running.

Other objects of this invention will become apparent as the following specification progresses, reference being had to the accompanying drawings for an illustration of the invention.

FIG. 1 is a side elevation view of a first embodiment of a shoe of the present invention having a shock absorber insert with side wall stabilizing members;

FIG. 1A is a vertical section through the shoe of FIG. 1;

FIG. 1B is an enlarged, fragmentary cross-sectional view of the bladder forming a part of the shock absorber of FIG. 1; the bladder having a flapper valve in an open position;

Figures 2, 3:
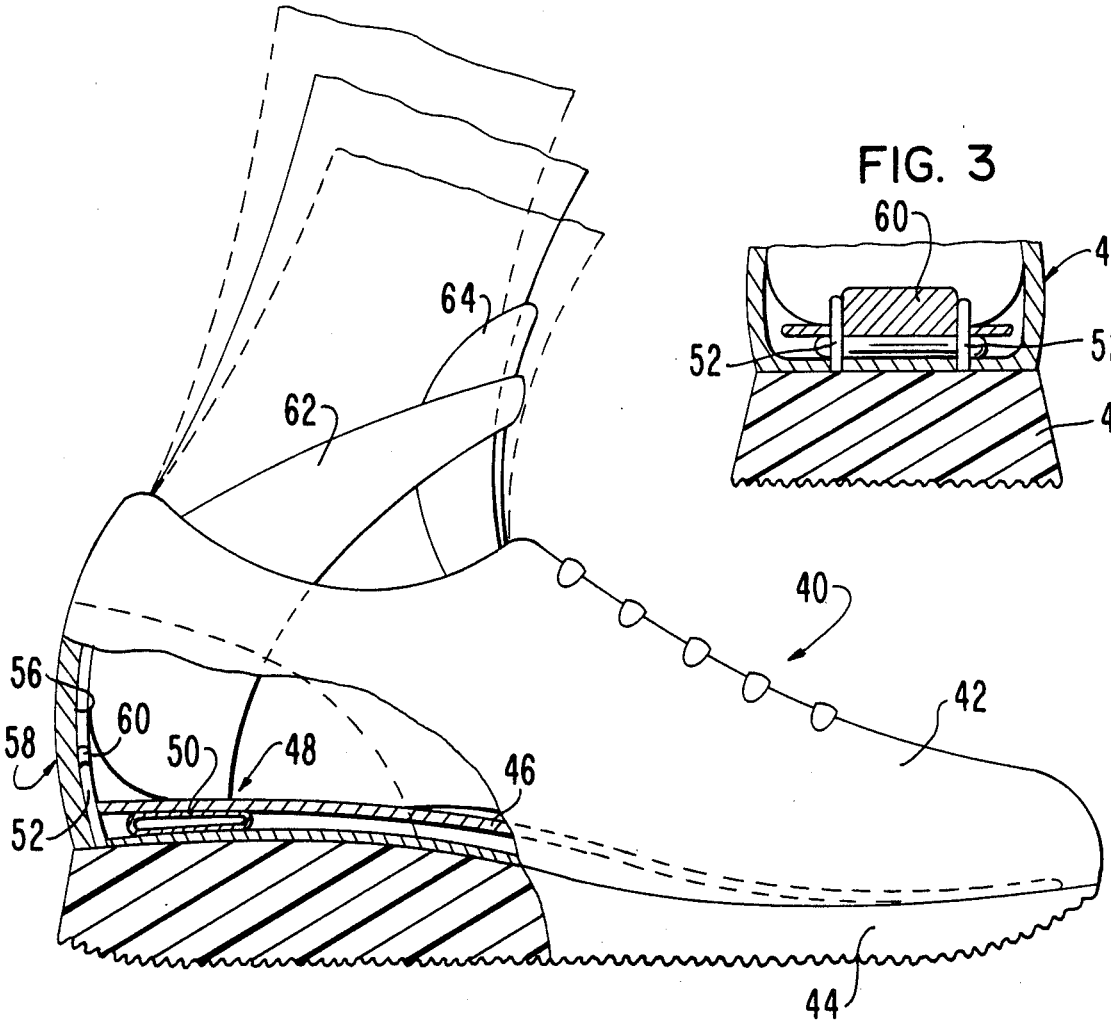

FIG. 1*c* is a plan view of a portion of the bladder of FIG. 1 showing the flapper valve closing a hole in the bladder;

FIG. 1*d* is an enlarged rear elevational view of the shock absorber insert showing an alternative stabilizing means consisting of crossed struts connecting the upper and lower plates;

FIG. 1*e* is a fragmentary top plan view of the hinge of FIG. 1;

FIG. 2 is a view similar to FIG. 1 but showing a second embodiment of a shoe of this invention. The bladder forming a part of the shock absorber is a closed system;

FIG. 3 is a vertical section through the shoe of FIG. 2;

FIG. 4 is a view similar to FIGS. 1 and 2 but showing a third embodiment of a shoe of this invention;

FIG. 5 is a cross-sectional view taken along line 5—5 of FIG. 4;

FIG. 5A is an enlarged rear elevational view of the adjustable valve forming a part of the shock absorber of the shoe of FIG. 4;

FIG. 5B is a vertical section through the valve of FIG. 5A;

FIG. 5C is a bottom plan view of a compressible plug forming a part of the shock absorber of the shoe of FIG. 4;

FIG. 5D is a transverse side elevational view of the compressible plug of FIG. 5C;

FIG. 6 is a fragmentary side elevational view of the embodiment of FIG. 4 showing the lateral stabilizing plate and nesting box;

FIG. 7 is a view similar to FIGS. 1, 2 and 4 but showing a fourth embodiment of a shoe of this invention;

FIG. 8 is a vertical section through the shoe of FIG. 7; and

FIG. 9 is a fragmentary side elevational view of the embodiment of FIG. 7 showing the deformation of the sole upon foot strike.

A first embodiment of the shoe of the present invention is broadly denoted by the numeral 10 and includes an upper shell 12 attached to a lower sole 14. The upper shell and lower sole are conventional in construction and can be formed of any suitable materials. Also, the shoe can be a dress shoe, a casual shoe or a sport shoe, such as a running shoe; thus, the teachings of the present invention are not limited to use with any particular type of shoes.

Shoe 10 includes an insole or footbed 16 which, for purposes of illustration, extends from the arch of the upper shell to the rear end thereof. Insole 16 has a shock absorber insert 18 attached thereto or imbedded therein near the rear end thereof. Insert 18 includes an upper, flat plate 20 and a lower flat plate 22 which are pivotally interconnected with each other at their front ends by a hinge 24. The bottom plate 22 has opposed, stabilizing side plates 26 which are secured to and extend upwardly from the side margins of plate 22. Side plates 26 can extend only partially forwardly from the rear end of plate 22 as shown in FIG. 1, or plates 26 can extend almost to hinge 24, whichever if desired. In the latter case, the plates 26 are generally triangular in configuration and extend along the side margins of plates 20 and 22.

Plate 20 has a pair of flat side flanges 27 which are adjacent to the inner surfaces of respective side plates 26. Flanges 27 shift relative to side plates 26 and are guided thereby as plate 20 moves toward and away from plate 22. Also, flanges 27 are held against lateral movement by side plates 26.

Insert 18 further includes an inflatable bladder 28 which is provided with a relatively large opening 30 and a flapper valve 32 for closing opening 30 when the bladder is compressed. Valve 32 has a relatively small opening 33 therein. The bladder is placed between plates 20 and 22 as shown in FIGS. 1 and 1A, and the opening is near the upper rear end of the bladder to cushion the downward movement of upper plate 20 as the heel of the foot in shoe 10 moves downwardly when the shoe strikes the ground.

The bladder 28 is of any suitable shape. For purposes of illustration, the bladder is rectangular; however, it can be circular or any other shape as well. Its thickness is less than its width so that the bladder can conveniently underlie the major portion of the heel of the foot for maximum cushioning of the heel during downward movement of the heel. The bladder, for instance, could be loosely received in the space between plates 20 and 22 or it could be adhesively bonded to either or both of such plates. The bladder is of a resilient material, such as rubber.

In use, assuming that bladder 28 has air in it and that the wearer of shoe 10 is striding such that shoe 10 is moving downwardly, the heel of the wearer presses down on insert 18, forcing plate 20 downwardly toward plate 22. This causes bladder 28 to be compressed to force air from the bladder out of the small opening 33, thereby allowing air to escape from the bladder to the atmosphere through opening 33 because flapper valve 32 will close the larger opening 30. This air, therefore, escapes with difficulty and passes out of the shoe along the inner, rear surface of the shoe. As the air slowly leaves the bladder, a bellows effect is created, and because the bladder can collapse to a minimal height during heel strike, and because shifting of the stabilizing side plates provides lateral stability, stability and cushioning are significantly increased for the distance between the heel and support surface therebelow during mid-stance compared to that achieved with conventional walking or running shoes.

As the foot is lifted during toe off and swing-through of the foot, the bladder 28 expands to allow air to rush into the bladder through the relatively large opening 30 past the flapper valve 32, since the flapper valve is now opened. This action allows the bladder to inflate rapidly and the bladder is then in condition for use as a shock absorber during the next heel strike.

The shock absorber insert 18 in shoe 10 provides a footbed which permits reduction in sole wear and prolongs the shock absorbing qualities of the shoe. Insert 18, therefore, minimizes injury to the foot yet provides much greater comfort and stability to the wearer of the shoe than can be achieved with the shoe without insert 18.

Plates 20 and 22 permit maximum vertical displacement of bladder 28 yet side plates 26 and flanges 27 permit only minimal lateral displacement of the foot during heel strike. Lateral displacement can result in angulation of the sole and heel with consequent overpronation of the foot. Longitudinal instability of the sole is not critical in preventing overpronation and formation of the rigid lever for toe off. Plates 20, 22, and 26 and flanges 27 form a heel counter box or cavity for providing maximum lateral stability for the foot. These plates and flanges can be made of metal, plastic or other materials, and can be rigid or semi-rigid.

FIG. 1D is an enlarged, rear elevational view of a shock absorber insert **18*a* which is a modified version of the insert shown in FIGS. 1 and 1A. In insert 18*a*, upper plate 20*a* is pivotally connected by a hinge (not shown) to the front end of a bottom plate 22*a*. A bladder 28*a* is disposed between plates 20*a* and 22*a* much in the same manner as insert 28 is disposed between plates 20 and 22 (FIG. 1**).

Instead of using side plates 26, the insert of FIG. 1D has a pair of crossed struts **26*a* and 26*b* which are pivotally interconnected by pin 26*c* at the midpoints of the struts. Each strut has slotted members at the outer ends thereof for receiving adjacent pins 26*d* secured to the rear flat faces of respective plates 20*a* and 22*a*. Thus, struts 26*a* and 26*b* allow upper plate 20*a* to move upwardly and downwardly with respect to plate 22*a* without permitting any substantial lateral movement of plate 20*a* relative to plate 22*a***.

FIG. 1E shows a particular embodiment of the hinge 24 interconnecting the front ends of plates 20 and 22 (FIG. 1). Plate 24 is constructed in the same manner as a door hinge, with a hinge pin 25 and adjacent, tubular knuckles 29 on plates 20 and 22 for receiving pin 25.

Another embodiment of the shoe of the present invention is broadly denoted by the numeral 40 and includes an upper shell 42 attached to a lower sole 44. The shoe has an insole 46 provided with a shock absorber insert 48 which includes an air filled, closed bladder 50 which is imbedded in the insole 46 or below the insole and resting on the upper surface of sole 44.

Insert 48 further includes stabilizing means comprised of a pair of stabilizing pillars or pins 52 which are spaced apart and extend upwardly from the upper surface of sole 44 adjacent to the inner surface 56 at the rear portion 58 of shoe 40.

A footbed upright member 60 is secured to and extends upwardly from the rear end of insole 46. Member 60 is substantially rigid and is between and in engagement with pillars 52 so that the pillars serve to guide member 60 as the rear part of insole 46 moves up and down. Thus, the pillars provide lateral stability for insole 46 during heel strike and prevent lateral movement of insole 46 relative to sole 44.

Bladder 50 can be of the type shown in FIGS. 1 and 1A, if desired. However, insert 48 illustrates the fact that the bladder can be opened or closed to the atmosphere, as desired.

Shoe 40 further includes a strap 62 provided with a buckle or other fastening means (not shown) which can be used to further stabilize the foot. The strap is typically forward of an upper, rear part 64 of the tongue of shoe 40 so that the strap is across the leg of the wearer. The purpose of strap 62 is to cause a lifting of the rear part of insole 46 as the wearer flexes the leg during walking or running and just prior to lifting of the foot off the support surface therebelow for follow through of the foot in making the next step.

While pillars 52 can be mounted in any suitable manner, typically, they are imbedded in sole 44. They can be made of any suitable material, such as metal or plastic and can be rigid or semirigid. Similarly, the rear end portion of insole 46 and member 60 are generally rigid or semirigid and can be made of a metal, plastic or other suitable material.

In the use of shoe 40, a foot strike will cause bladder 50 to flatten as the rear portion of insole 46 descends due to impact by the heel of the foot. During this time, member 60 is guided downwardly and retained against side movement by pillars 52 so as to avoid lateral instability of the rear portion of insole 46. In this way, the foot is cushioned, yet the foot does not become subjected to lateral forces which would occur in the absence of pillars 52 and member 60.

Another embodiment of the shoe of the present invention is broadly denoted by the number 70 and includes an upper shell 72 mounted on a lower sole 74. An insole 76 above sole 74 is provided with a shock absorber insert 78 near the rear end thereof. Insert 78 includes an inflatable bladder 80 below the rear portion of insole 76 and supported on sole 74. Bladder 80 is adapted to contain air, and the bottom part of the bladder has an opening 82 communicating with an L-shaped fluid passage 84 extending downwardly from opening 82 into sole 74 and then through sole 74 rearwardly thereof to an opening at the rear end 86 of the sole 74.

The front and rear walls 88 and 90 of bladder 80 are spring-like to provide a bellows effect to cause expansion of the bladder into the full line position thereof as shown in FIG. 4 when no downward force is exerted on the bladder. A flapper valve 92 is used to close opening 82 when a downward force is exerted on the upper wall of the bladder, allowing air to flow through a relatively small opening 94 in the flapper valve, the air flowing outwardly of the bladder through passage 84.

A compressible plug 96 on the inner surface of the upper wall of bladder 80 (FIGS. 4 and 5) is formed by a suitable compressible material, such as rubber. The plug has a cross-shaped groove 98 (FIGS. 5C and 5D) in its lower surface. The central part of groove 98 vertically overlies the small hole 94 in flapper valve 92 so that, when a downward force is applied to the rear part of insole 76, plug 96 is moved downwardly against the bias forces of the front and rear sides 88 and 90 of bladder 80 to cause flapper valve 92 to close the relatively large opening 82 yet allow air to flow out of the interior of the bladder through groove 98, small hole 94 and passage 84 to the atmosphere. As plug 96 is progressively compressed with downward movement of the insole, the groove 98 in plug 96 is substantially closed. Thus, the pneumatic spring rate of the shock absorber is increased and controlled.

An adjustable valve 100 is provided at the rear end of passage 84 to meter the flow of air into and out of the tube. Valve 100 includes an inner wall 102 provided with a crescent-shaped hole 108 alignable with a crescent-shaped hole 110 in the outer wall 104. Wall 104 has a knurled flange 112 surrounding the outer periphery of wall 102, and wall 104 is rotatable by a pin 106 relative to wall 102 to vary the size of the air passage formed by the combined effect of openings 108 and 110. This air passage can be fully or partially opened or can be fully closed by proper adjustment of outer wall 104 relative to inner wall 102.

To provide lateral stability for shoe 70, insert 78 has a pair of stabilizing plates 116 imbedded in sole 74 as shown in FIGS. 5 and 6 and extending upwardly from the sole. The upper margins of plates 116 are shiftably received in hollow boxes 118 which are carried by the heel counter sides 120 of shoe 70. Insole 76 has a pair of side flanges 122 (FIG. 5) which are guided by the upper margins of plates 116 as the rear portion of insole 76 moves downwardly and upwardly relative to sole 74. Thus, plates 116 and flanges 122 form a box structure which provides lateral stability for the foot during walking and running. Boxes 118 permit vertical movement of plates 116 during compression of sole 74.

In use, assuming bladder 80 is filled with air as shoe 70 moves downwardly, a foot strike forces the rear part of insole 76 downwardly to compress bladder 80. This causes air to flow out of the bladder through large hole 82 and passage 84 to the atmosphere. Eventually, plug 96 will engage flapper valve 92, closing opening 82 and allowing air in the bladder to pass through groove 98 into and through relatively small hole 94, into passage 84 and out of the tube past valve 100. The amount of difficulty of the air leaving the bladder will be determined by the setting of valve 100 as well as the spring constant defined by front and rear sides 88 and 90 of bladder 80. This spring constant will determine the rate at which plug 96 moves into a position closing flapper valve 92 to thereby enclose opening 82.

As the shoe is lifted during toe off and follow-through movement of the foot, the resilience of sides 88 and 90 will cause the bladder to increase in volume, creating a vacuum which opens valve 92, allowing air to rush into the bladder through valve 100, passage 84 and into the bladder through opening 82. This action occurs at a relatively short time because of the relatively large size of opening 82 and because of the vacuum created by the lifting of the upper wall of the bladder under the bias force of sides 88 and 90. Eventually, the bladder will expand sufficiently so that it will be ready to cushion the shock of the next foot strike as the shoe is lowered into engagement with a surface below the shoe. Thus, the shock absorber insert 78 of shoe 70 provides a cushioning effect to cushion the shock of downward movement of the heel in the shoe yet the insert provides lateral stability by way of plates 116 and flanges 122.

FIG. 7 shows a fourth embodiment of a shoe of the present invention, the shoe being denoted by the numeral 130 and having an upper shell 132 and an outer lower sole 134. The outer sole 134 is formed from an elastomer material, such as rubber, neoprene, or the like, and the outer sole 134 has an air chamber 136 therein near the rear end thereof. Chamber 136 is formed by an upper wall 138 and a lower wall 139, wall 138 having a hole 140 (FIG. 7) therethrough which communicates with the atmosphere. An insole 142 is mounted in the shoe and the rear end of the insole is slightly forwardly of hole 140 as shown in FIG. 7.

The resilience of the material of outer sole 134 provides an inherent bias which tends to expand chamber 136 into the full line position of FIG. 8 when no downward force is exerted on upper wall 138. Thus, during a heel strike, the heel forces wall 138 downwardly against wall 139 (FIG. 9) causing chamber 136 to decrease in volume and causing air to be forced out of chamber 136 through opening 140 to the atmosphere. This causes a bellows effect which cushions the shock of the downward movement of the heel yet chamber 136 is sufficiently low with reference to the lower surface of outer sole 134 so that the foot has maximum stability in the shoe.

A pair of stabilizing plates 143 are provided at the sides of sole 134 near chamber 136 as shown in FIGS. 7–9. Each plate 143 has a flange 141 at its lower end to anchor the plate in sole 134. The upper margins of plates 143 extend upwardly from sole 134 and are received in boxes 144 imbedded in the sides 146 of shoe 130. Each box 144 may contain a leaf spring 245 to engage and bias the corresponding plate 143 downwardly. FIG. 7 shows the side plates 143 before the deformation of upper wall 138 relative to lower portion 139, and FIG. 9 shows the deformation of the sole upon foot strike with plates 143 deeper in boxes 144. Thus, the box like construction defined by plates 143 and boxes 144 provide lateral stability for the shoe along with the cushioning action afforded by top wall 138.

During toe off and follow-through of the shoe, the shoe is lifted off the ground and when this occurs, the inherent resilience of sole 134 causes chamber 136 to expand, creating a partial vacuum in the chamber and drawing air suction into the chamber 136 through hole 140. The movement of the air into chamber 136 is sufficiently rapid so that the chamber is effectively filled with air before the next heel strike. Thus, the lower extremity of the wearer of the shoe is protected against damage, yet the shoe is simple and rugged in construction and provides lateral stability and cushioning over long periods of time.

The embodiments of the present invention shown in FIGS. 1–6 can be provided with springs for the same purpose as spring 147 (FIGS. 7–9), namely, to bias the lateral stabilizing plates into initial positions.

What is claimed is:

1. A shoe comprising: an upper shell; a lower sole secured to the upper shell; a shock absorber mounted on the shoe for cushioning the foot during foot strike; a first means coupled to the shoe and extending upwardly from the lower sole and second means shiftable relative to the first means for providing lateral stability for the foot during foot strike.

2. A shoe as set forth in claim 1, wherein said providing means is within the shoe.

3. A shoe as set forth in claim 1, wherein said providing means includes means defining a box structure.

4. A shoe as set forth in claim 1, wherein said providing means includes a pair of plates on opposite sides of said shock absorber.

5. A shoe as set forth in claim 1, wherein said providing means is rearwardly of the shock absorber.

6. A shoe as set forth in claim 1, wherein said shock absorber includes an upper plate, a lower plate, and a bladder between said plates, there being means pivotally interconnecting the plates, whereby compression of the bladder will occur when the plates move relative to and toward each other.

7. A shoe as set forth in claim 6, wherein the upper and lower plates have front ends, said pivot means interconnecting the front ends of the plates, said bladder being near the rear ends of the plates.

8. A shoe as set forth in claim 6, wherein the bladder is open to the atmosphere.

9. A shoe as set forth in claim 8, wherein the bladder has an air opening therein and a flapper valve for closing the air opening during heel strike.

10. A shoe as set forth in claim 6, wherein said providing means includes means defining a box structure with the upper and lower plates.

11. A shoe as set forth in claim 6, wherein the upper and lower plates are substantially rigid.

12. A shoe as set forth in claim 6, wherein the upper and lower plates are substantially semi-rigid.

13. A shoe as set forth in claim 1, wherein the shock absorber includes an insole and a bladder below the insole.

14. A shoe as set forth in claim 13, wherein the bladder is inflated and closed to the atmosphere.

15. A shoe as set forth in claim 13, wherein the providing means is rearwardly of the insole and the bladder.

16. A shock absorber as set forth in claim 1, wherein said outer sole has a rear portion provided with an expansion chamber, said outer sole being formed of a elastomer material, whereby the chamber will decrease in volume as a downward force is exerted by the foot on the upper portion of the outer sole.

17. A shoe as set forth in claim 16, wherein the outer sole has an upper wall provided with a hole therethrough placing the chamber in fluid communication with the atmosphere.

18. A shoe comprising: an upper shell; a lower sole secured to the upper shell; a shock absorber mounted on the shoe for cushioning the foot during foot strike, said shock absorber including an upper plate, a lower plate, and a bladder between said plates, there being means pivotally interconnecting the plates, whereby compression of the bladder will occur when the plates move relative to and toward each other, the bladder having an air opening therein and a flapper valve for closing the air opening during heel strike, the valve having an opening therethrough alignable with the opening in the bladder when the bladder opening is closed by the valve, the opening of the valve being of a size different from the bladder opening; and means coupled to the shoe and shiftable relative to the shoe for providing lateral stability for the foot during foot strike.

19. A shoe comprising: an upper shell; a lower sole secured to the upper shell; a shock absorber mounted on the shoe for cushioning the foot during foot strike, said shock absorber including an upper plate, a lower plate, and a bladder between said plates, there being means pivotally interconnecting the plates, whereby compression of the bladder will occur when the plates move relative to and toward each other, said defining means including a pair of side flanges for each of the upper and lower plates, respectively, each side flange of the upper plate being adjacent to and shiftable relative to a respective side-flange of the lower plate.

20. A shoe comprising: an upper shell; a lower sole secured to the upper shell; a shock absorber mounted on the shoe for cushioning the foot during foot strike, said shock absorber including an upper plate, a lower plate, and a bladder between said plates, there being means pivotally interconnecting the plates, whereby compression of the bladder will occur when the plates move relative to and toward each other; and a pair of pivotally interconnected, crossed struts, the outer ends of the struts being pivotally connected to the upper and lower plates for providing lateral stability for the foot during foot during foot strike.

21. A shoe comprising: an upper shell; a lower sole secured to the upper shell; a shock absorber mounted on the shoe for cushioning the foot during foot strike, the shock absorber including an insole and a bladder below the insole; and means for providing lateral stability for the foot during foot strike, said providing means including an upright member secured to the rear end of the insole, and guide means on the upper for retaining the member against lateral movement relative to the upper.

22. A shoe as set forth in claim 21, wherein said guide means includes a pair of spaced pillars secured to the outer sole and extending upwardly therefrom within the shoe near the rear end of the upper.

23. A shoe comprising: an upper shell; a lower sole secured to the upper shell; a shock absorber mounted on the shoe for cushioning the foot during foot strike, the shock absorber including an insole and a bladder below the insole; means coupled to the shoe and shiftable relative to the shoe for providing lateral stability for the foot during foot strike; and a strap coupled with the insole for raising the same relative to the outer sole as the shoe is lifted off a supporting surface therebelow.

24. A shoe comprising: an upper shell; a lower sole secured to the upper shell; a shock absorber mounted on the shoe for cushioning the foot during foot strike; and a pair of side plates secured to and extending upwardly from the lower sole within the shoe near the rear end of the upper, said shock absorber including an insole having a pair of side flanges adjacent to and shiftable relative to the side plates, said side plates being operable to retain said flanges and said insole against lateral movement as the insole moves up and down relative to the outer sole to thereby provide lateral stability for the foot during foot strike.

25. A shoe as set forth in claim 24, wherein said shock absorber further includes a bladder below the inside and above the outer sole.

26. A shoe as set forth in claim 25, wherein said bladder has spring means thereon for causing the bladder to expand as the insole moves upwardly relative to the outer sole.

27. A shoe as set forth in claim 26, wherein the bladder is open to the atmosphere.

28. A shoe as set forth in claim 26, wherein said bladder has a first opening therethrough, a valve for closing said first opening when the volume of the bladder is decreased, and a tube coupled with the first opening and extending through the outer sole for placing the bladder in fluid communication with the atmosphere.

29. A shoe as set forth in claim 28, wherein the valve has a second hole therethrough, the second hole being different in size from the first hole and being aligned with the first hole.

30. A shoe as set forth in claim 28, said tube having a second valve coupled thereto for metering the airflow therethrough.

31. A shoe as set forth in claim 30, wherein the second valve is at the outer end of the tube.

32. A shoe as set forth in claim 30, wherein the tube has a rear end rearwardly of the outer sole and provided with an adjustable valve at the outer end thereof.

33. A shoe as set forth in claim 32, wherein said adjustable valve includes a pair of adjacent relatively shiftable walls, each wall having an opening alignable with the opening in the other wall.

34. A shoe as set forth in claim 33, wherein a first wall is secured to the rear end of the tube, the second wall being pivotally mounted on the first wall, each of the walls having an opening, the openings being adjustably alignable with each other.

35. A shoe as set forth in claim 26, wherein said spring means includes a pair of resilient sides for the bladder.

36. A shoe as set forth in claim 28, wherein is included a compressible plug carried in the bladder for closing the valve as the bladder decreases in volume.

37. A shoe as set forth in claim 36, wherein the plug has a lower surface provided with a groove, said valve having a hole therethrough communicating with the chamber through the groove in the plug when the plug closes the valve.

38. A shoe comprising: an upper and an outer sole secured to the upper; a shock absorber mounted on the shoe and having an air-receiving chamber, said shock absorber having means for placing the chamber in fluid communication with the atmosphere for all positions of the heel with respect to the shock absorber; and an insole above the outer sole, said shock absorber including a bladder between the outer sole and the insole, the bladder having an air opening therethrough and a valve, said air opening being closeable by the valve, the bladder having a first large hole defining said air opening therethrough, said valve having a second hole aligned with the first large hole, said second hole being different in size from the first hole, said bladder being secured to the insole.

39. A shoe comprising: an upper shell; a lower sole secured to the upper shell; a shock absorber mounted on the shoe for cushioning the foot during foot strike, said shock absorber including an upper plate, a lower plate and a bladder between said plates, there being means interconnecting said plates; and laterally stabilizing means coupled to the shoe and shiftable relative to the shoe including means defining a box structure with the upper and lower plates comprising side flanges for each of the upper and lower plates, respectively, each side flange of the upper plate being adjacent to and shiftable relative to a respective side flange of the lower plate, whereby compression of the bladder will occur when the plates move relative to and toward each other.

40. A shoe comprising: an upper shell; a lower sole secured to the upper shell; a shock absorber mounted on the shoe for cushioning the foot during foot strike: a first means coupled to the shoe and extending upwardly from the lower sole and a second means shiftable relative to the first means for providing lateral stability for the foot during foot strike and allowing the potential vertical compression of the shock absorber available for energy absorption.

* * * * *